US011384986B2

(12) United States Patent
Shen et al.

(10) Patent No.: US 11,384,986 B2
(45) Date of Patent: Jul. 12, 2022

(54) OPEN ARC CONDITION MITIGATION BASED ON MEASUREMENT

(71) Applicant: Hatch Ltd., Mississauga (CA)

(72) Inventors: Dong Shen, Oakville (CA); Michael Morgan Campbell, Toronto (CA); Steven Robert Hawthorne, Toronto (CA)

(73) Assignee: Hatch Ltd., Mississauga (CA)

( * ) Notice: Subject to any disclaimer, the term of this patent is extended or adjusted under 35 U.S.C. 154(b) by 312 days.

(21) Appl. No.: 16/499,708

(22) PCT Filed: Jan. 22, 2018

(86) PCT No.: PCT/CA2018/050072

§ 371 (c)(1),
(2) Date: Sep. 30, 2019

(87) PCT Pub. No.: WO2018/176119

PCT Pub. Date: Oct. 4, 2018

(65) Prior Publication Data

US 2020/0041208 A1 Feb. 6, 2020

Related U.S. Application Data

(60) Provisional application No. 62/480,317, filed on Mar. 31, 2017.

(51) Int. Cl.
*H05B 7/148* (2006.01)
*F27D 19/00* (2006.01)
(Continued)

(52) U.S. Cl.
CPC ..... *F27D 19/00* (2013.01); *F27D 11/08* (2013.01); *F27D 21/00* (2013.01); *H05B 7/148* (2013.01); *F27D 2019/0034* (2013.01)

(58) Field of Classification Search
CPC ..... F27D 19/00; F27D 21/00; F27D 11/08; F27D 11/10; F27D 2019/0034;
(Continued)

(56) References Cited

U.S. PATENT DOCUMENTS 5,043,735 A 8/1991 Mawhinney et al.
5,148,177 A 9/1992 Nagamune et al.
(Continued)

FOREIGN PATENT DOCUMENTS

CA 2463130 4/2003
CA 2925349 4/2015
(Continued)

OTHER PUBLICATIONS

US 6,519,274 B2, 02/2003, Ma et al. (withdrawn)
(Continued)

*Primary Examiner* — Hung D Nguyen
(74) *Attorney, Agent, or Firm* — Ridout and Maybee LLP

(57) ABSTRACT

A system measures parameters of the electricity drawn by an arc furnace and, based on an analysis of the parameters, provides indicators of whether arc coverage has been optimized. Factors related to optimization of arc coverage include electrode position, charge level, slag level and slag behaviour. More specifically, such indicators of whether arc coverage has been optimized may be used when determining a position for the electrode such that, to an extent possible, a stable arc cavity is maintained and an open arc condition is avoided. Conveniently, by avoiding open arc conditions, the internal linings of the furnace walls and roof may be protected from excessive wear and tear.

21 Claims, 13 Drawing Sheets

(51) Int. Cl.
*F27D 11/08* (2006.01)
*F27D 21/00* (2006.01)

(58) Field of Classification Search
CPC . F27D 2019/0037; H05B 7/144; H05B 7/148; H05B 7/156; F27B 3/28; Y02P 10/20; Y02P 10/216; Y02P 10/25; Y02P 10/256; Y02P 10/259; Y02P 10/286; Y02P 10/32; Y02P 10/34
USPC ..... 373/60, 63, 65, 70, 102, 104, 108
See application file for complete search history.

(56) References Cited

U.S. PATENT DOCUMENTS

| | | | | |
|---|---|---|---|---|
| 6,573,691 | B2 | 6/2003 | Ma et al. | |
| 6,603,795 | B2 * | 8/2003 | Ma ..... | H05B 7/148 373/102 |
| 8,482,295 | B2 | 7/2013 | Sadri et al. | |
| 9,417,321 | B2 | 8/2016 | Sadri et al. | |
| 9,417,322 | B2 | 8/2016 | Sadri et al. | |
| 2007/0133651 | A1 | 6/2007 | Gerhan et al. | |
| 2012/0152057 | A1 | 6/2012 | Mikami | |
| 2016/0258682 | A1 | 9/2016 | Barker et al. | |

FOREIGN PATENT DOCUMENTS

| | | |
|---|---|---|
| CN | 1691228 | 11/2005 |
| CN | 1331774 | 8/2007 |
| CN | 101492750 | 7/2009 |
| JP | 2003207382 A | 7/2003 |
| WO | 2006087203 | 8/2006 |
| WO | 2016183672 | 11/2016 |

OTHER PUBLICATIONS

International Search Report and Written Opinion PCT/CA2018/050072 dated Apr. 16, 2018.
IPRP; PCT/CA2018/050072 Oct. 10, 2019.
Office Action; Canadian Application No. 3058510 dated Jan. 22, 2020.
Office Action; Canadian Application No. 3058510 dated Aug. 25, 2020.

* cited by examiner

OPEN ARC CONDITION MITIGATION BASED ON MEASUREMENT

FIELD

The present application relates generally to AC and DC electric arc furnaces and, more specifically, to open arc condition mitigation based on measurement for such furnaces.

BACKGROUND

An electric arc furnace is a device in which material may be heated by means of an electric arc. Electric arc furnaces are used in a variety of applications in a wide range of scales, from a few dozen grams to hundreds of tons. One application for electric arc furnaces is secondary steelmaking. Another application is the smelting of non-ferrous ores. The latter is often a shielded arc smelting application of electric arc furnaces.

An Alternating Current (AC) electric arc furnace uses a furnace transformer to deliver power from a power grid to an arc at two or more electrode tips. A Direct Current (DC) electric arc furnace uses a rectifier transformer and a rectifier to deliver power from the power grid to an arc at one or more electrode tips.

In the secondary steelmaking application and the shielded arc smelting application, variations in the load experienced by the power grid that supplies electricity to the electric arc furnace give rise to something called "power grid flicker." Unfortunately, power grid flicker can be shown to cause malfunction in sensitive electronic equipment and lighting. Furthermore, power grid flicker can be shown to disturb other consumers on the same power grid. Even further, excessive power grid flicker can violate an electricity contract entered into by the operator of the electric arc furnace.

One contributing factor to stability in the power drawn, from the power grid, by the electric arc furnace is the presence or absence of an arc cavity.

BRIEF DESCRIPTION OF THE DRAWINGS

Reference will now be made, by way of example, to the accompanying drawings which show example implementations; and in which.

DETAILED DESCRIPTION

Figure 1:
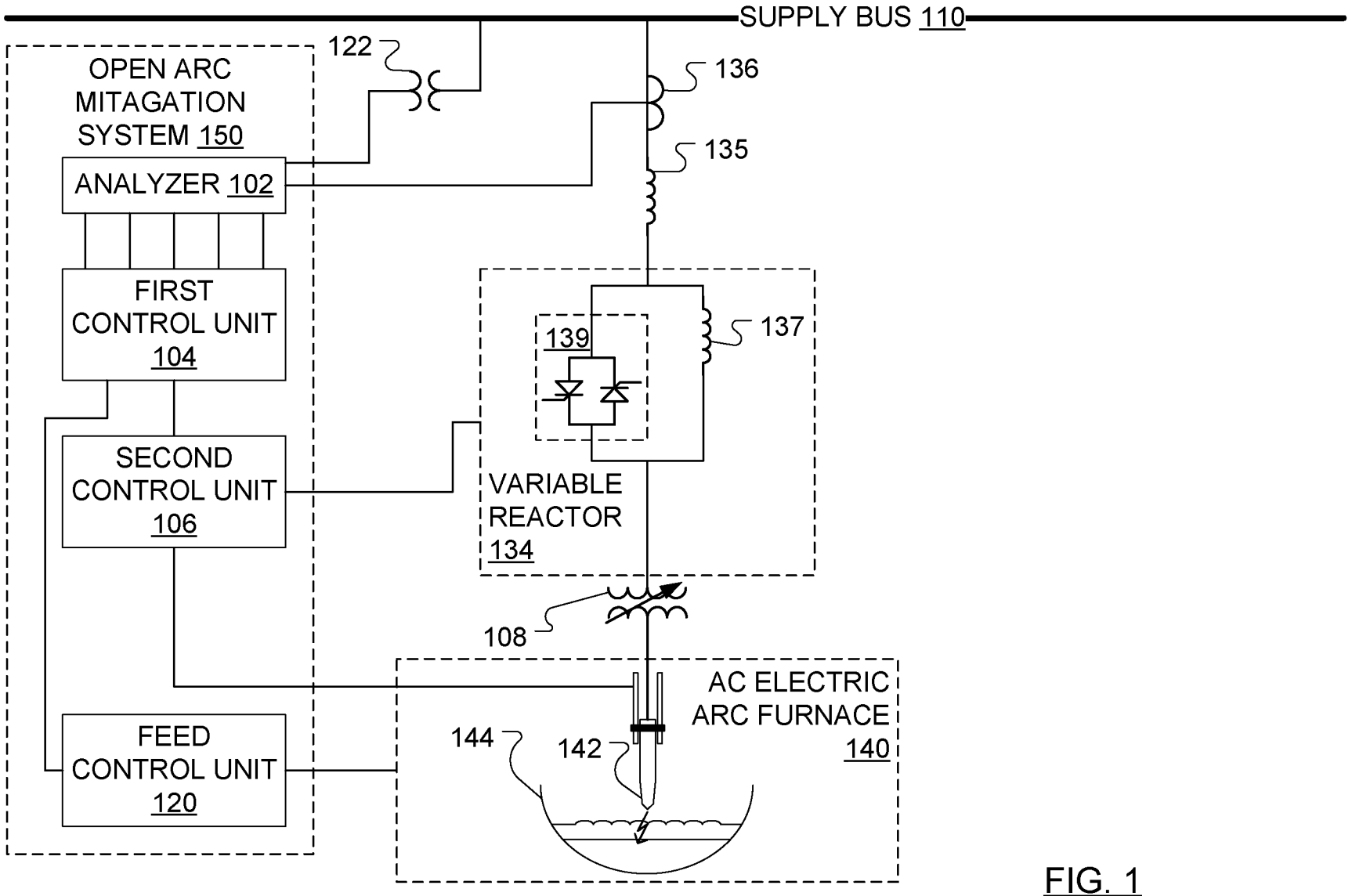
FIG. 1 illustrates a system including an AC electric arc furnace in combination with a variable reactor and an open arc mitigation system including an analyzer and a first control unit, wherein the analyzer receives measurement from a primary side of a furnace transformer in accordance with aspects of the present application.

A system measures parameters of the electricity drawn by an arc furnace and, based on an analysis of the parameters, provides indicators of whether arc coverage has been optimized. Factors related to optimization of arc coverage include electrode position, charge level, slag level and slag behavior. More specifically, such indicators of whether arc coverage has been optimized may be used when determining a position for the electrode such that, to an extent possible, a stable arc cavity is maintained and an open arc condition is avoided. Conveniently, by avoiding open arc conditions, the internal linings of the furnace walls and roof may be protected from excessive temperature and wear.

According to an aspect of the present disclosure, there is provided a system including an analyzer and a first control unit. The analyzer is adapted to receive a signal representative of an electrical signal measurement of the electrical power provided to an electric arc furnace and analyze the signal to determine, by analyzing the electrical signal measurement, a characteristic electrical parameter. The first control unit is adapted to receive the characteristic electrical parameter, determine, based upon the characteristic parameter, a change in operation for the electric arc furnace and transmit, to a second control unit provided for the electric arc furnace, an indication of the change.

According to another aspect of the present disclosure, there is provided a method. The method includes receiving a characteristic electrical parameter related to operation of an electric arc furnace, determining, based upon the characteristic electrical parameter, a change in operation for the electric arc furnace, where the change is related to mitigating an open arc condition and transmitting, to a control unit provided for operation of the electric arc furnace, an indication of the change.

According to a further aspect of the present disclosure, there is provided a method of open arc detection. The method includes obtaining an electrical signal measurement, detecting, based upon the electrical signal measurement, an open arc condition, determining, based upon the electrical signal measurement, a change in operation for the electric arc furnace, where the change is related to ending the open arc condition and transmitting, to a control unit associated with operation of the electric arc furnace, an indication of the change.

Other aspects and features of the present disclosure will become apparent to those of ordinary skill in the art upon review of the following description of specific implementations of the disclosure in conjunction with the accompanying figures.

Traditionally, power grid flicker (or, simply, "flicker") may be mitigated by installing shunt reactive power compensation equipment. Examples of reactive power compensation equipment include a traditional Static VAR Compensator (SVC) or a more advanced, power-converter-based, Static Synchronous Compensator (STATCOM). Another proven technology for flicker reduction is a Smart Predictive Line Controller (SPLC), which may be connected in series with a fluctuating load.

In electric power transmission and distribution, volt-ampere reactive (VAR) is a unit in which reactive power is expressed in an Alternating Current (AC) electric power system. Reactive power exists in an AC circuit when the current and voltage are not in phase.

An SVC consists of a shunt-connected harmonic filter bank and a shunt-connected thyristor-controlled reactor. The filter bank and the thyristor-controlled reactor operate in concert to lower voltage flicker, maintain constant supply bus voltage or maintain a constant power factor. The SVC operates by shunt injection of either capacitive reactive power or inductive reactive power, thereby maintaining a constant voltage by maintaining the total reactive power draw (MVAR) of the furnace balanced near zero (i.e., neither inductive nor capacitive). SVCs typically have a half cycle time delay due to thyristor commutation requirements. An example of an early SVC can be seen in U.S. Pat. No. 3,936,727.

SVC-based arc furnace controllers dynamically supply reactive power by the controlled summation of constant capacitive MVAR and variable inductive MVAR. The controller compares load reactive power to a reactive power set-point derived from power factor set-point and dynamically controls the summated MVAR to the set-point. As a secondary steelmaking electric arc furnace frequently short circuits and open circuits during the bore-down phase of the furnace electrodes, the furnace reactive power swings vary from zero to 200% of the furnace transformer rating. An SVC is normally sized at 125% to 150% of the furnace rating and typically reduces flicker by approximately 40% to 50%. Some SVCs use a voltage set-point and adjust a shunt reactor to match a supply voltage to the set-point voltage.

An SPLC consists of a thyristor controlled reactor connected in series with an electrode of the electric arc furnace. An SPLC functions as a dynamically controlled series reactor that uses predictive software to stabilize the real power or the current on an electric arc furnace. The SPLC reduces flicker by lowering arc current fluctuations on the power systems. When arc current fluctuations are flat-lined, the voltage flicker is reduced. An example of an SPLC can be seen in U.S. Pat. No. 5,991,327 issued Nov. 23, 1999.

FIG. 1 illustrates an example of an SPLC in series with one electrode 142 of a multiple electrode AC electric arc furnace (EAF) 140. Three phase power is provided to the electric arc furnace 140 from a local supply bus 110. The supply bus 110 is connected to receive power from a utility power supply through transmission line and step down transformer (not shown) or, alternatively, from a local generating station (not shown). The electric arc furnace 140, being an AC electric arc furnace, often includes multiple electrodes 142 (not individually illustrated), with an individual one of the multiple electrodes or one pair of the multiple electrodes 142 being associated with an individual one of the phases among the three power phases. Arcing ends of the electrodes 142 are positioned in a furnace vessel 144 to, for example, melt a work material, such as scrap metal, and may be mounted such that the position of the electrode 142 within the furnace vessel 144 can be adjusted. The electrodes 142 are connected to a furnace side (secondary windings) of a tapped furnace transformer 108.

A variable reactor is connected, in series with the tapped furnace transformer 108, between the electric arc furnace 140 and the supply bus 110. Each of the three phases of the variable series reactor (only one phase of which is illustrated) includes a series combination of a variable reactor 134, a fixed reactor 135 and a current transformer 136 connecting a respective phase of a supply side (primary windings) of the furnace transformer 108 to a corresponding phase of the supply bus 110. In the illustrated embodiment, the representative variable reactor 134 includes a reactor 137 connected in parallel with a thyristor switch 139. Each thyristor switch 139 preferably includes a pair of thyristors, or pairs of thyristor groups, arranged in opposite polarity to each other. The variable series reactor has a control range. The thyristor switch 139 may be considered to be a specific implementation of what may be called a power electronics static switch.

Figure 3:
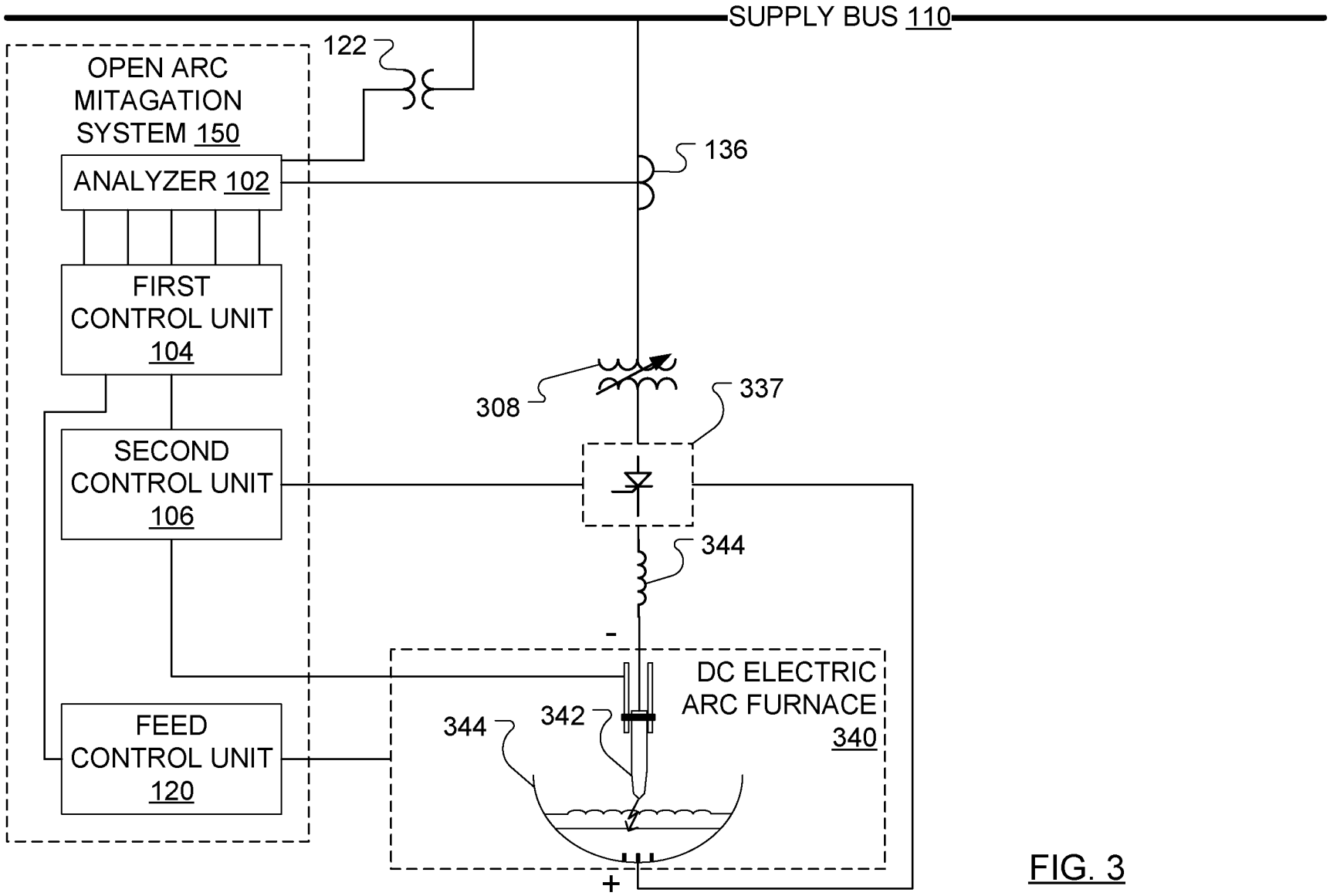
FIG. 3 illustrates the system of FIG. 1 as applied to a DC electrical arc furnace in accordance with aspects of the present application.

FIG. 3 illustrates a DC electric arc furnace 340 and its related connection to the supply bus 110. The connection to the supply bus 110 includes a rectifier 337 and a DC reactor 344 on a furnace side of a furnace transformer 308.

Figure 4:
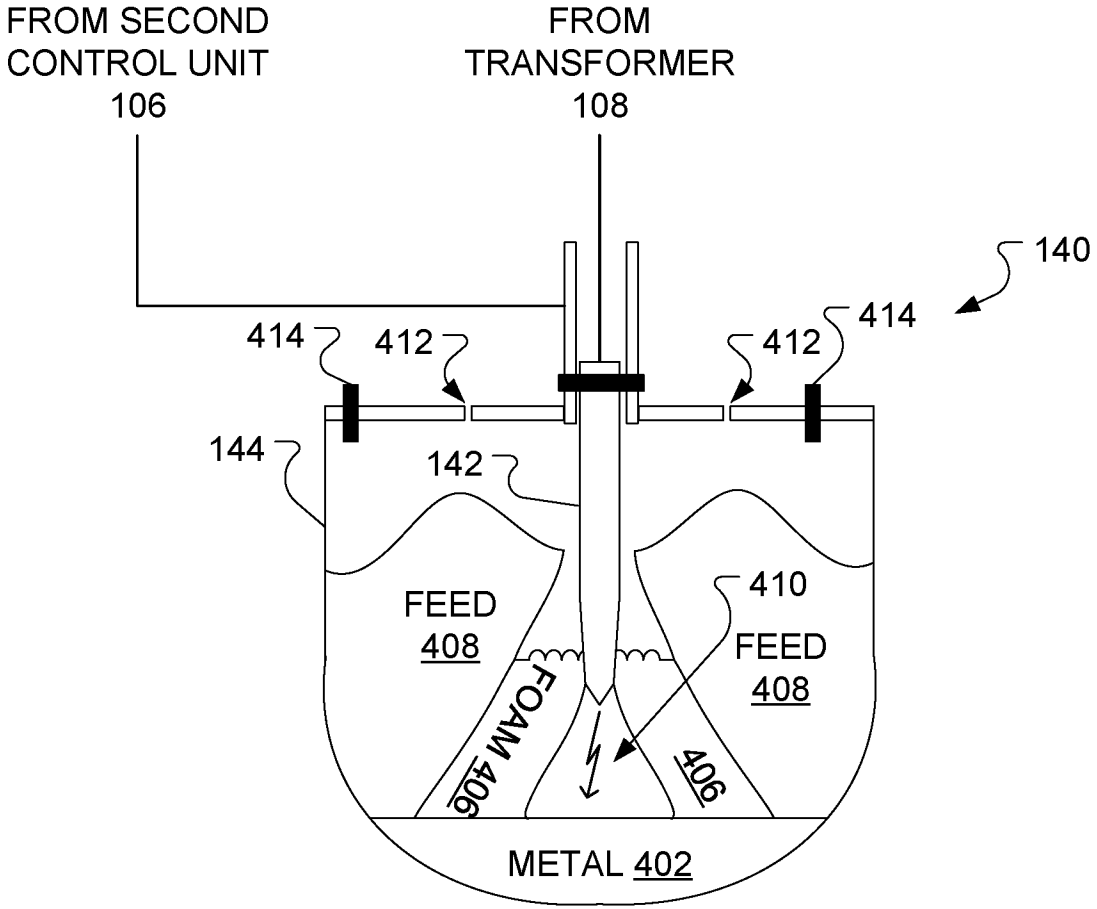
FIG. 4 illustrates a steel scrap furnace implementation of the electric arc furnace of FIG. 1 with an arc cavity.

Operation of the EAF 140 may be considered in view of FIG. 4, illustrating the electric arc furnace 140, in section, being used for processing scrap steel. Within the furnace vessel 144, during operation, there are several zones of material. At the bottom of the furnace vessel 144, a molten metal (e.g., steel) layer 402 collects. Above the metal layer 402 are piles of feed 408 (e.g., scrap steel). In one manner of adding scrap steel to the furnace vessel 144, the roof of the furnace vessel 144 is moved aside to allow a bucket of scrap steel to be dumped into the furnace vessel 144.

The feed 408 in the electric arc furnace 140 of FIG. 4 may be iron or steel material distinct from scrap steel. For example, the feed may be Direct Reduced Iron (DRI), Hot Briquetted Iron (HBI) or molten iron from a blast furnace.

In one manner of adding feed to the steel furnace, certain iron or steel material may be fed into the furnace vessel 144 through a plurality of apertures 412.

Responsive to arcs from the electrode 142, a volume of foamy slag 406 forms around the tip of the electrode 142. The height and distribution of the piles of feed 408 may be measured by a plurality of level measurement units 414. Example devices for use as the level measurement units 414 exist and may use such technology as RADAR.

Responsive to an arc being repeatedly generated at the end of the electrode 142, an "arc cavity" 410 may be understood to form. There is a mutually beneficial relationship that forms within the arc cavity 410. Responsive to the arc being repeatedly generated at the end of the electrode 142, an ionized plasma column is formed. It turns out that an ionized plasma column is beneficial to the generation of the next arc. The ionized plasma column may be considered to be hot. Indeed, the ionized plasma column may be, for example, maintained at 5000 degrees Kelvin. Conveniently, the heat of the plasma column may be considered to assist in the maintenance of the ionization of the plasma column. Furthermore, a hot plasma column allows for the possibility of relatively long arcs. The heat of a long arc is preferred over the heat of shorter arcs because of lower furnace power loss. Accordingly, an operator of the EAF 140 is interested in adjusting the position of the electrode 142 to allow for long arcs.

Figure 5:
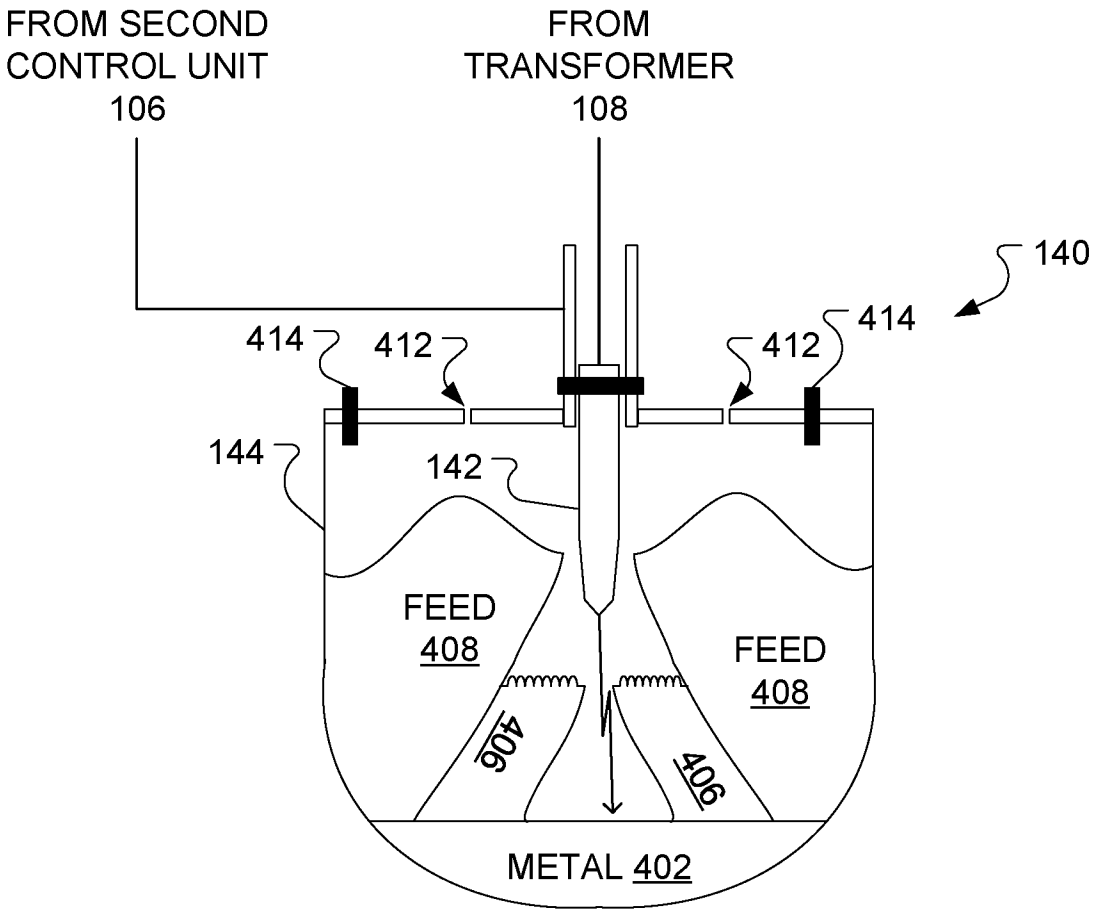
FIG. 5 illustrates the steel scrap furnace implementation of FIG. 4 in an open arc condition.

FIG. 5 illustrates the steel scrap furnace implementation of FIG. 4 in an open arc condition. The open arc condition may result responsive to something causing an absence of the arc cavity 410. In FIG. 5, for example, the absence of the arc cavity 410 may be caused by a change in the foaminess of the foamy slag 406. In the open arc condition, the internal linings of the furnace walls and roof are in danger of experiencing excessive temperature and wear.

Figure 6:
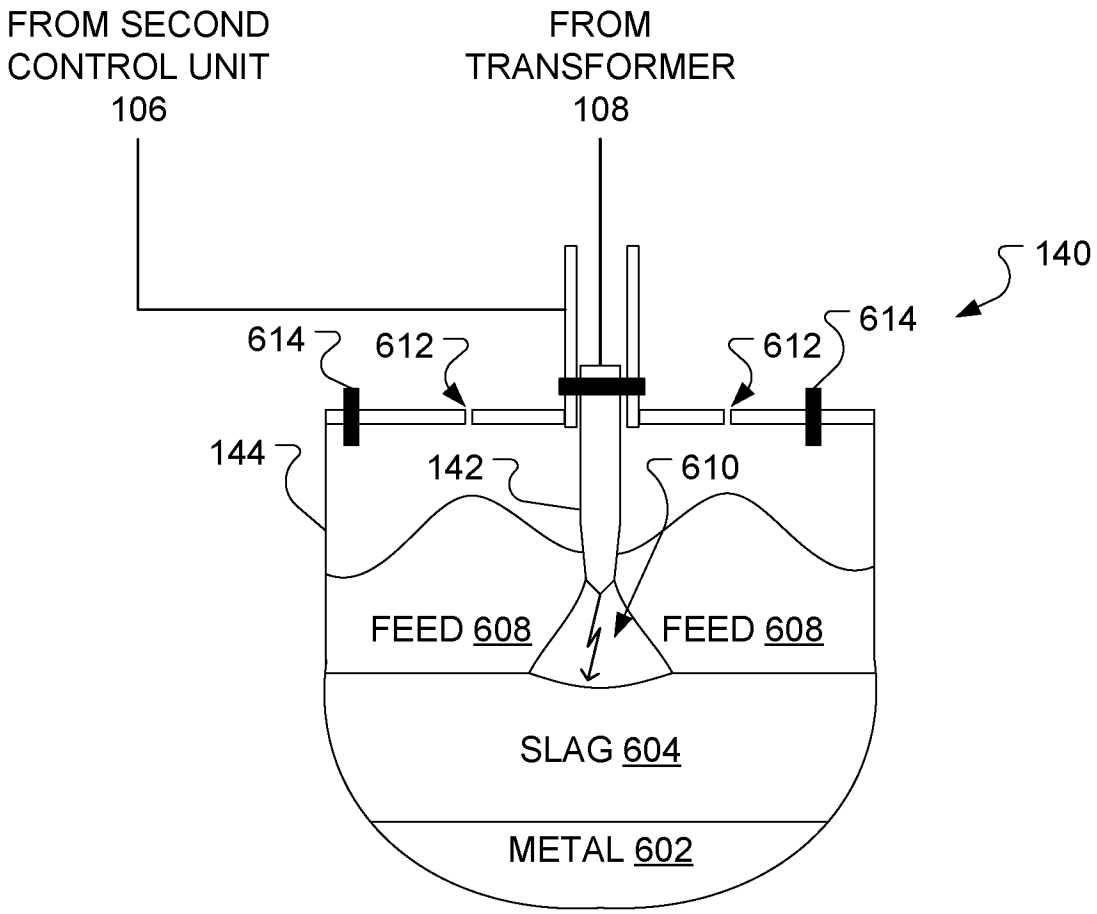
FIG. 6 illustrates a non-ferrous shielded arc smelting furnace (without foam) implementation of the electric arc furnace of FIG. 1 with an arc cavity.

FIG. 6 illustrates the non-ferrous shielded arc smelting furnace 140, in section, being used in an application that does not, generally, lead to foamy slag. Within the furnace vessel 144, during operation, there are several zones of material. At the bottom of the furnace vessel 144, a molten metal layer 602 (e.g., ferro-nickel) collects. Above the metal layer 602 is a slag layer 604. Sitting on top of the slag layer 604 are piles of feed 608. The feed 608 is fed into the furnace vessel 144 through a plurality of apertures 612.

The height and distribution of the piles of feed 608 may be measured by a plurality of level measurement units 614.

Responsive to arcs from the electrode 142, the feed 608 may be converted to the slag 604 and the metal 602. In contrast with the application illustrated in FIG. 4, the slag 604 is not foamy. Also responsive to arcs being repeatedly generated at the end of the electrode 142, an arc cavity 610 may be understood to form.

Figure 7:
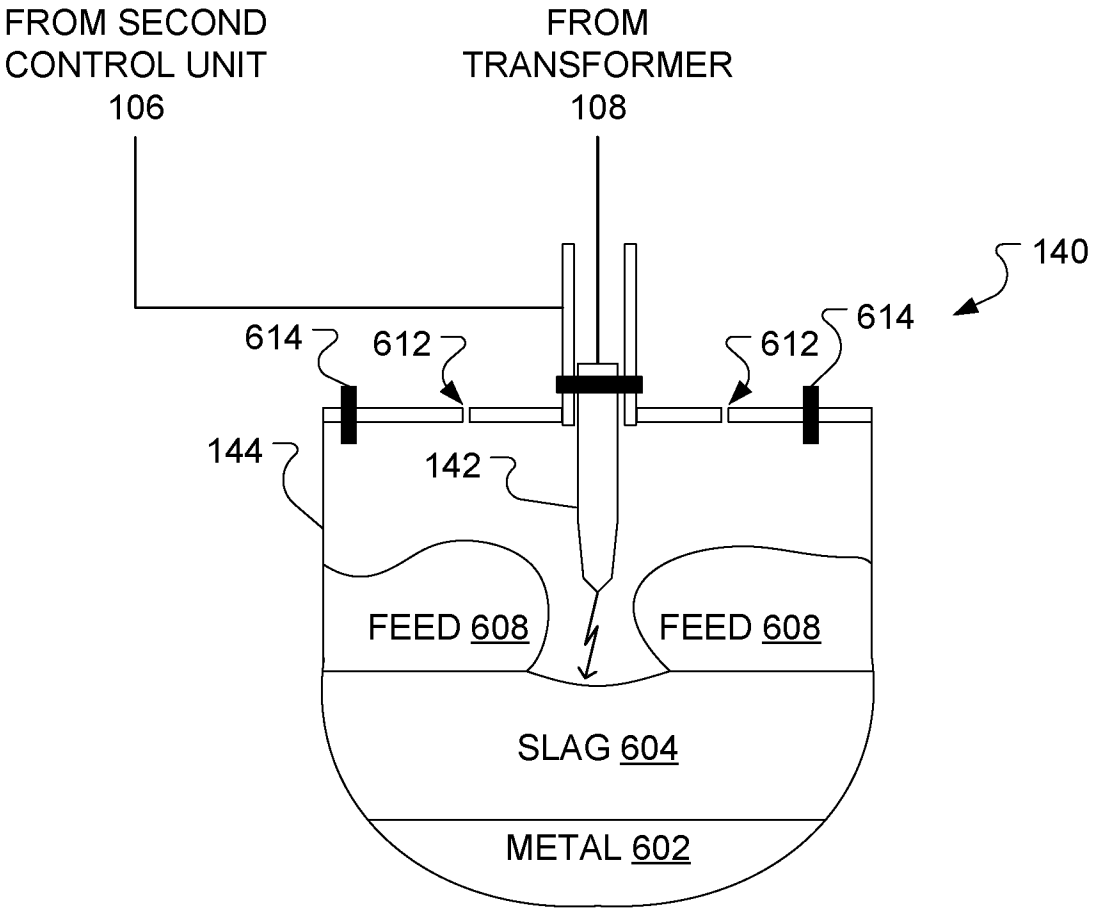
FIG. 7 illustrates the non-ferrous shielded arc smelting furnace implementation of FIG. 6 in an open arc condition.

FIG. 7 illustrates the non-ferrous shielded arc smelting furnace of FIG. 6 in an open arc condition. In FIG. 7, the absence of the arc cavity 610 may be caused by a shifting of the feed 608.

Figure 8:
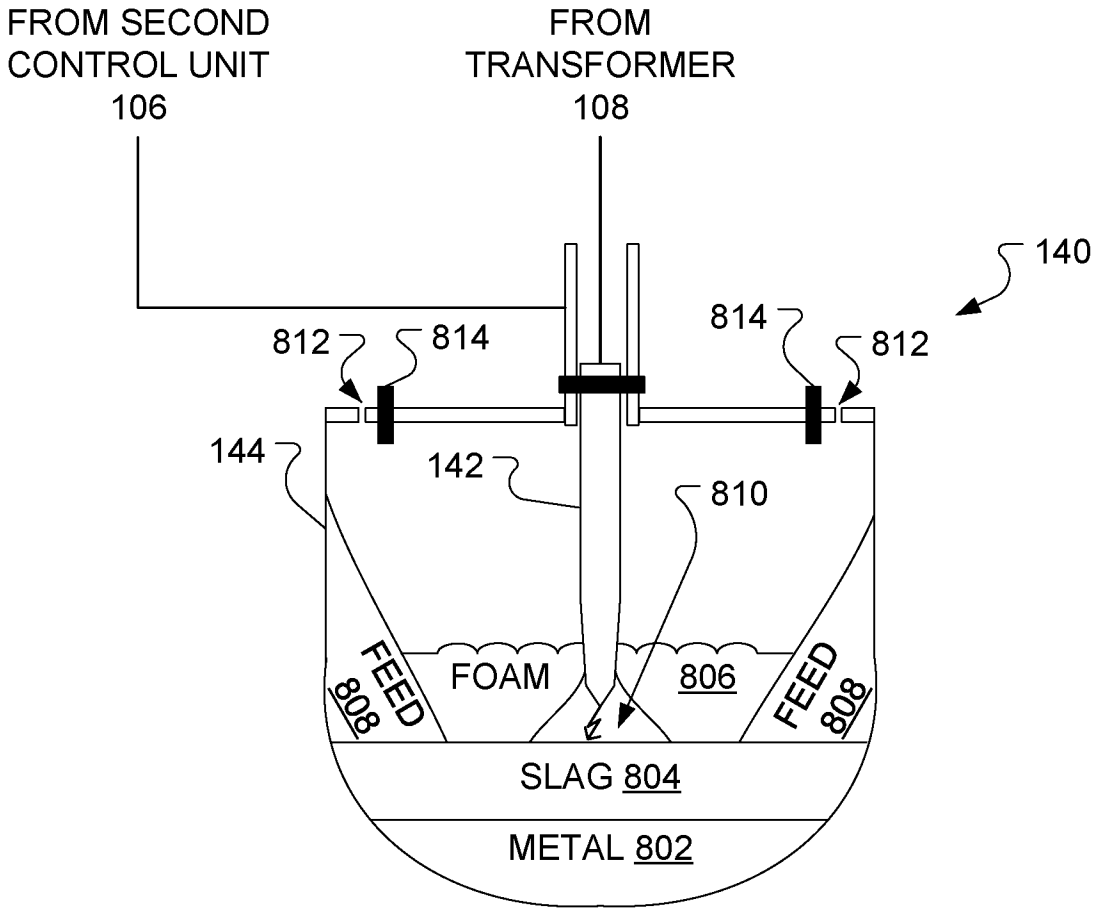
FIG. 8 illustrates a non-ferrous shielded arc smelting furnace (with foam) implementation of the electric arc furnace of FIG. 1 with an arc cavity.

FIG. 8 illustrates the electric arc furnace 140, in section, being used in a non-ferrous shielded arc smelting application with foamy slag. Within the furnace vessel 144, during operation, there are several zones of material. At the bottom of the furnace vessel 144, a molten metal layer 802 collects. Above the metal layer 802 is a slag layer 804. Sitting on top of the slag layer 804 are piles of feed 808. The feed 808 is fed into the furnace vessel 144 through a plurality of apertures 812.

The height and distribution of the piles of feed 808 may be measured by a plurality of level measurement units 814.

Responsive to arcs from the electrode 142, the feed 808 may be converted to the slag 804 and the metal 802. In common with the application illustrated in FIG. 4, the slag 804 is foamy, forming a foamy slag layer 806. Also responsive to arcs being repeatedly generated at the end of the electrode 142, an arc cavity 810 may be understood to form.

Figure 9:
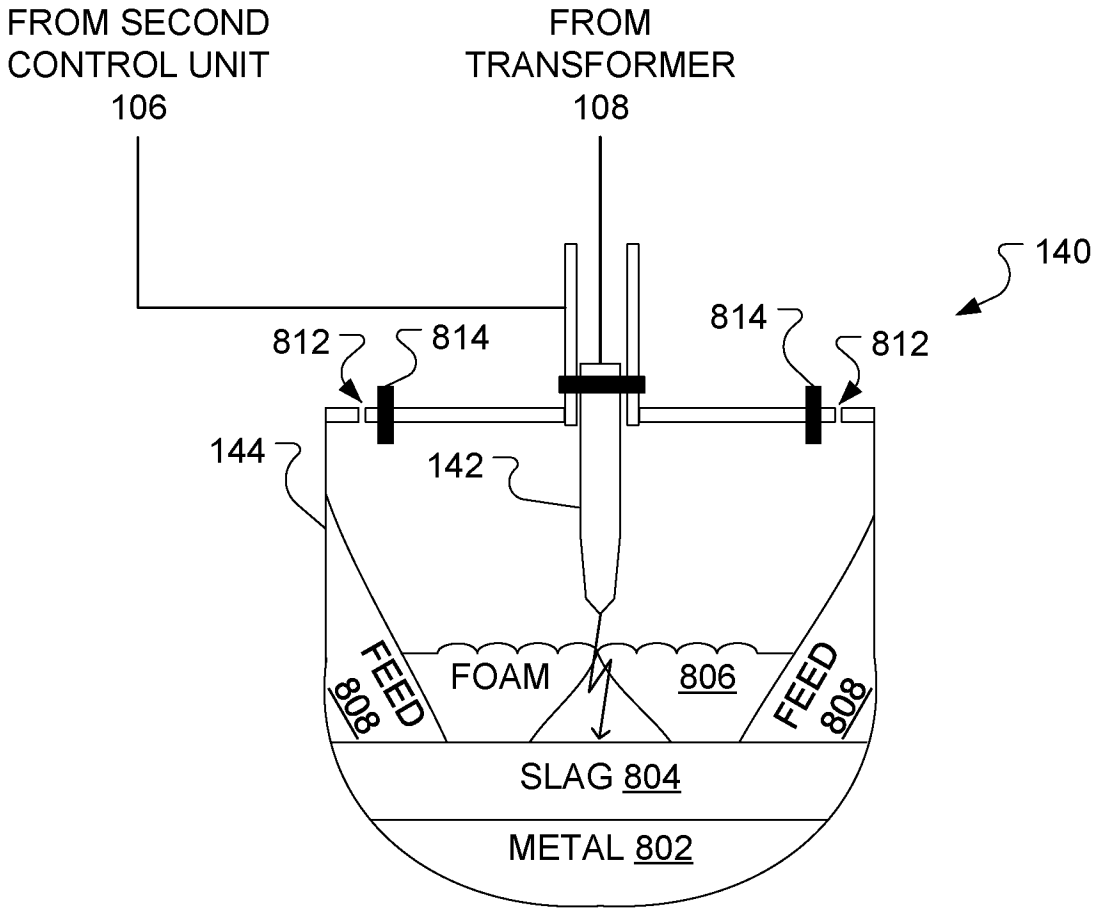
FIG. 9 illustrates the non-ferrous shielded arc smelting furnace implementation of FIG. 8 in an open arc condition.

FIG. 9 illustrates the non-ferrous shielded arc smelting furnace implementation of FIG. 8 in an open arc condition. In FIG. 9 an absence of the arc cavity 810 may be caused by a change in the foaminess of the foamy slag 806.

It is notable that a plasma column that is hot is understood to be associated with a power draw that is much more stable than the power draw present in an open arc condition. Accordingly, an operator of the EAF 140 is interested in maintaining the arc cavity 410, 610, 810 and, by doing so, the operator of the EAF 140 may be seen to be avoiding an open arc condition.

The arc cavity 410, 610, 810 is also beneficial because, when the arc cavity 410, 610, 810 is present, the roof of the furnace vessel 144 and the upper sidewalls of the furnace vessel 144 are shielded from the arc generated by the electrode 142, thereby prolonging the expected lifetime of the furnace vessel 144. In the application illustrated in FIG. 4, the shielding is accomplished by a combination of the feed 408 and the foamy slag 406. In the application illustrated in FIG. 6, the shielding is accomplished by the feed 608. In the application illustrated in FIG. 8, the shielding is accomplished by the foamy slag layer 806.

It may be seen, therefore, that there is a balance to be struck between raising the electrode 142 to achieve a long arc in the arc cavity 410, 610, 810 and avoiding the open arc condition, which condition may be seen to be more likely as the electrode 142 is raised.

At relatively high power level, which may be defined, for example, as greater than 60 Mega Watts, electrical resistance may be seen to increase responsive to the raising of the electrode 142. A stable power measurement and a stable resistance measurement may be understood to be indicative of the electrode 142 being well positioned within the material that optimally surrounds the end of the electrode 142. That material may be, in some applications, foamy slag, and may be, in other applications, granular feed banks.

Unfortunately, the depth of the foam layer 406, 806 and the feed 408, 608, 808 can be inconsistent. Accordingly, even when the position of the electrode 142 is maintained, a reduction of the depth of the foam layer 406, 806 or the feed 408, 608 may cause an open arc condition. It follows that a reduction in the depth of the foam layer 406, 806 may result in more frequent open arc conditions. Operation in an open arc condition may be shown to be associated with a higher resistance than the resistance measured during operation with the arc cavity 410, 610, 810. Furthermore, operation in an open arc condition may be shown to make arc re-ignition more difficult. Operation in an open arc condition may be shown to result in higher fluctuation in furnace power draw than the fluctuation in furnace power draw measured during operation with the electrode 142 in the arc cavity 410, 610, 810.

Insufficient arc coverage may occur based upon a variety of factors. One factor is the resistance of the slag. That is, due to the composition of the slag, the electrical resistivity of the slag may be lower or higher than expected. Another factor related to the composition of the slag relates to the extent to which the slag layer 804 forms the foam layer 806. It turns out that the carbon content of the slag in the slag layer 804 relates directly to the extent to which the slag layer 804 forms the foam layer 806. Another factor leading to insufficient arc coverage is insufficient volume of slag in the slag layer 804. That is, a desired depth and volume in the foam layer 806 may not be achievable given a lower than desired depth and volume in the underlying slag layer 804. For the steel scrap furnace implementation of FIG. 4, the quality of the scrap metal 402, the carbon injection, the temperature and the lime injection will impact the depth and volume of the foam layer 406.

In an aspect of the present application, the SPLC of FIG. 1 is augmented with an open arc condition mitigation system 150. The open arc condition mitigation system 150 includes an analyzer 102 connected to the SPLC in a manner that allows for the collection of electrical parameters characterizing the electricity drawn by the EAF 140. The analyzer 102 provides output to a first control unit 104. In turn, the first control unit 104 provides output to a second control unit 106 and a feed control unit 120.

The analyzer 102, the first control unit 104, the second control unit 106 and the feed control 120 are shown as separate elements in FIG. 1. However, it should be understood that these elements may be implemented in hardware as a single unit or as multiple units.

In overview, the analyzer 102 obtains measurements of each phase of the power being drawn by the EAF 140 and analyzes the measurements. In one instance, the analyzer 102 obtains voltage measurements via a voltage transformer 122. In another instance, the analyzer 102 obtains current measurements via a current transformer 136. The analyzer 102 passes data to the first control unit 104. The first control unit 104 determines, for each phase, the extent to which various operating parameters should be changed and instructs the second control unit 106 to carry out the changes. The second control unit 106, acting upon the instructions from the first control unit 104, adjusts operating parameters of the EAF 140 and the variable reactor 134.

Figure 2:
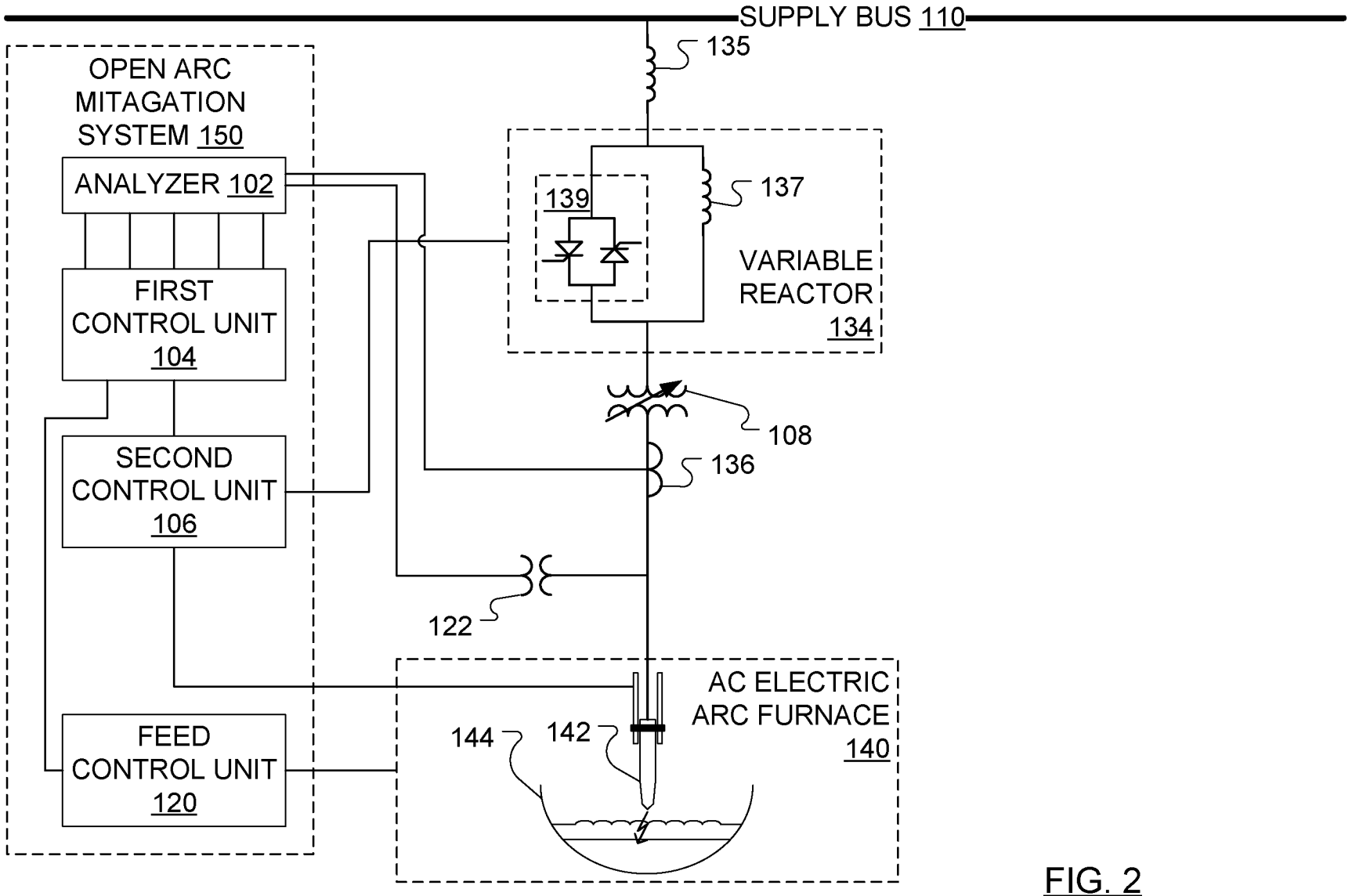
FIG. 2 illustrates the system of FIG. 1, wherein the analyzer receives measurement from a secondary side of the furnace transformer in accordance with aspects of the present application.

FIG. 2 illustrates the system of FIG. 1, wherein the analyzer 102 receives measurements from a secondary side of the furnace transformer 108 in accordance with aspects of the present application. In particular, the measurements are obtained from the voltage transformer 122 and the current transformer 136 positioned between the furnace transformer 108 and the EAF 140.

Figure 10:
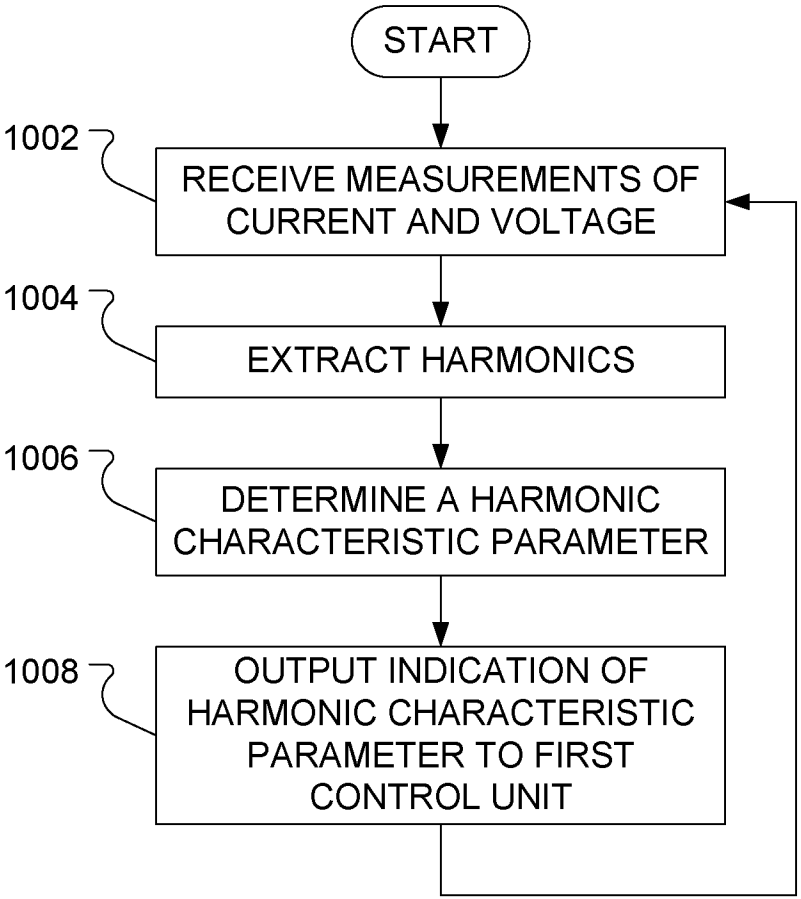
FIG. 10 illustrates steps of an example method of analyzing current and voltage measurements at the analyzer of FIG. 1.

In operation in view of FIG. 10, the analyzer 102 receives (step 1002) measurements of current and/or voltage from each phase. In one example, the analyzer 102 processes (step 1004) the measurements of the current and/or voltage to extract a plurality of harmonics of the current and/or voltage waveforms of the three phases. These harmonics, or a subset thereof, are then analyzed. The subset of harmonics may, for example, comprise just the lower order harmonics.

The analysis may, for example, involve determining (step 1006), for a selected time period, a particular harmonic characteristic parameter. More specifically, in one example, the analysis may be focused on a $3^{rd}$ harmonic parameter, a $5^{th}$ harmonic parameter, a total harmonic distortion (THD) parameter or a combination of these. The analyzer 102 may then output (step 1008) the determined harmonic characteristic parameter and return to receive (step 1002) further measurements.

Further particularly, in one example, the extracted $5^{th}$ harmonics of each phase may be compared to each other to determine which phase has the greatest $5^{th}$ harmonic. Once the phase having the greatest $5^{th}$ harmonic has been determined, the analyzer 102 may then output (step 1008), to the first control unit 104, the magnitude of the greatest harmonic, the magnitude of the corresponding fundamental and also a value representative of the largest $5^{th}$ harmonic divided by the corresponding fundamental harmonic.

The same process may be repeated for the $3^{rd}$ harmonic and for the THD.

Additionally, dependent upon configuration, the analyzer 102 may output (step 1008) a $5^{th}$ harmonic percentage, a $3^{rd}$ harmonic percentage or a THD percentage. Notably, for each harmonic, the analyzer 102 may employ an average value of all plurality of samples obtained in one second.

In sum, based on configuration, the analyzer 102 outputs (step 1008), to the first control unit 104, an indication of a selected harmonic parameter.

Figure 11:
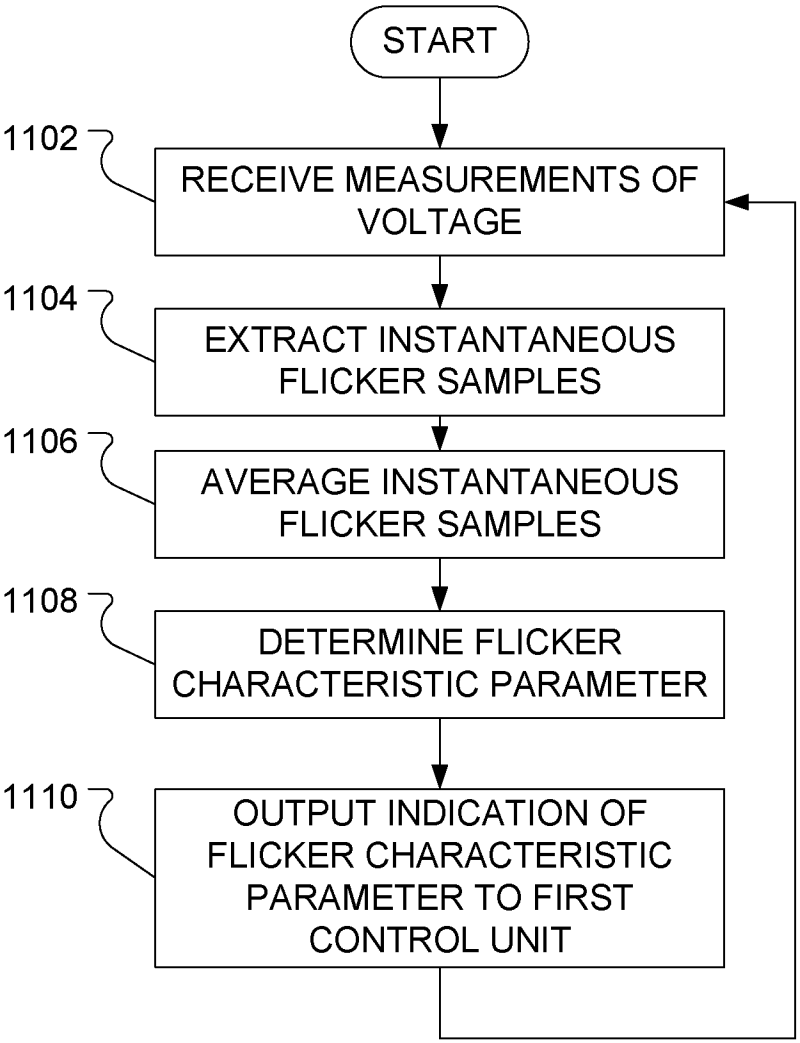
FIG. 11 illustrates steps of an example method of analyzing voltage measurements at the analyzer of FIG. 1.

In view of FIG. 11, the analyzer 102 may also receive (step 1102) measurements of voltage from each phase. The analyzer 102 may extract (step 1104) instantaneous voltage flicker samples and average (step 1106) voltage flicker samples in a time period for each phase. Based on the flicker samples, the analyzer 102 may determine (step 1108) a flicker characteristic parameter to associate with each phase. The analyzer 102 may determine (step 1108), for example, which phase has a flicker characteristic parameter that meets a predetermined criterion. More particularly, the greatest flicker characteristic parameter among the flicker characteristic parameters for the three phases may be of interest. The analyzer 102 may then output (step 1110) an indication of the flicker characteristic parameter that meets the predetermined criterion and return to receive (step 1102) further measurements.

Figure 12:
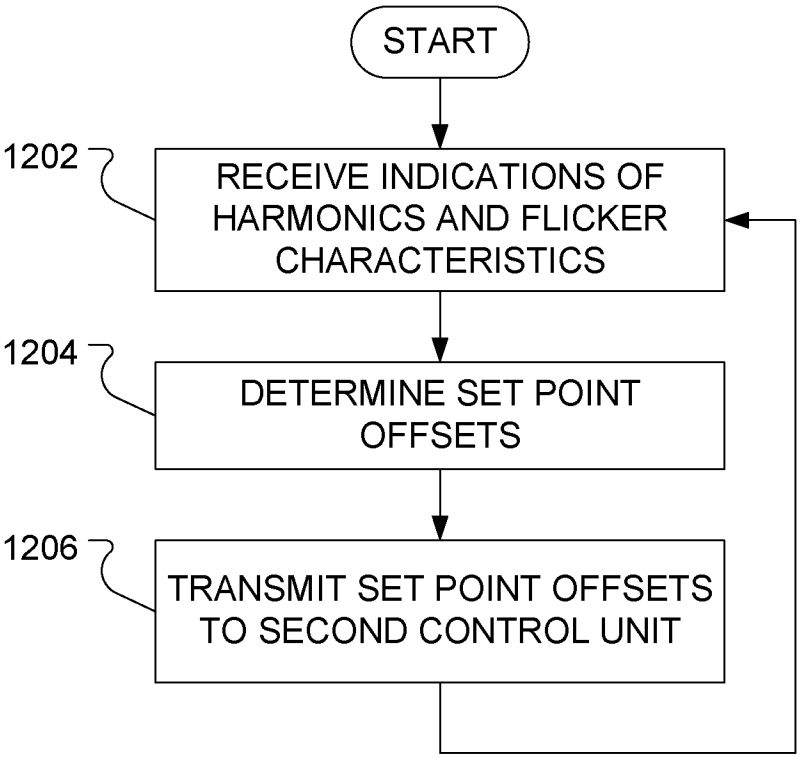
FIG. 12 illustrates steps of an example method of operating the first control unit of FIG. 1.

FIG. 12 illustrates steps of an example method of operating the first control unit 104. For one example, the first control unit 104 may, based on data received (step 1202) from the analyzer 102, determine (step 1204) a current set point offset. The first control unit 104 may then transmit (step 1206) the current set point offset (say, expressed in kilo Amps) to the second control unit 106 and return to receive (step 1202) further indications.

For another example, the first control unit 104 may, based on data received (step 1202) from the analyzer 102, determine (step 1204) a voltage set point offset. The first control unit 104 may then transmit (step 1206) the voltage set point offset to the second control unit 106 and return to receive (step 1202) further indications.

In each example of set point offset determination, the set point offset (current or voltage or both) is intended to mitigate changes in the arc cavity 410, 610, 810. Of particular concern is changes that are indicative of an open arc condition. The changes in the arc cavity 410, 610, 810 may, for one example, be related to changes in the quality of the foamy slag 406, 806. The changes in the arc cavity 410, 610, 810 may, for another example, be related to changes in the structure of the feed 408, 608, 808. The first control unit 104 may, based on data received from the analyzer 102, determine whether the data is indicative of an undesirable amount flicker and/or poor harmonics. The first control unit 104 may responsively generate a signal representative of bad foamy slag. Indeed, as the foam layer 406, 806 is either bad or not, the signal representative of the bad foamy slag may be a one-bit flag (a "Bad Foamy Slag" flag). In another aspect of the present application, the first control unit 104 may generate a signal representative of an open arc condition. Indeed, as the arc is either open or contained in the arc cavity 410, 610, 810, the signal representative of the open arc condition may be a one-bit flag (an "Open Arc Condition" flag).

The first control unit 104 may determine a value known as Flicker Error, which may be representative of a deviation of measured flicker from a flicker detection threshold. Similarly, the first control unit 104 may determine a value known as Harmonic Error, which may be representative of a deviation of measured harmonic value from a harmonic detection threshold.

The first control unit 104 may include a foamy slag override enable module (not shown). This module may be arranged to take the Flicker Error, Harmonic Error and the Open Arc Condition Flag to calculate a voltage set point offset and current set point offset (step 1206).

Upon receipt of the current set point offset, the second control unit 106 may control the variable reactor 134 to regulate the current to the revised current setpoint.

Upon receipt of the voltage set point offset, the second control unit 106 may use the voltage set point offset to determine a new position for the electrode 142. The second control unit 106 may then control the electrode 142 to move to the new position.

The second control unit 106 may be further adapted to control, based on values received from the first control unit 104, the firing angle of the thyristor switch 139.

As discussed hereinbefore, one aspect of the operation of the EAF 140 is the feeding of new material into the furnace vessel 144 through the plurality of apertures 412, 612, 812.

In one aspect of the present application, the analysis performed at the analyzer 102 in combination with the determinations, made at the first control unit 104, with regard to whether there is an open arc condition, may be used to adjust a rate at which new material is fed into the furnace vessel 144. Further data, indicative of the height and distribution of the piles of feed 408, 608, 808 within the furnace vessel 144, may also be useful when adjusting the rate at which new material is fed into the furnace vessel 144.

Figure 13:
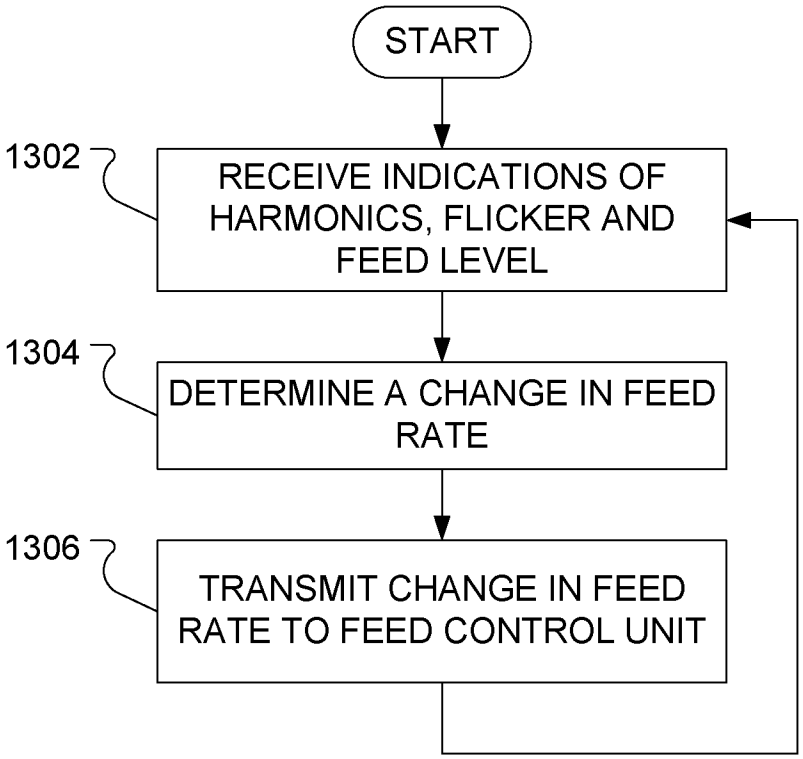
FIG. 13 illustrates steps of another example method of operating the first control unit of FIG. 1.

FIG. 13 illustrates steps of another example method of operating the first control unit 104. In this example, the first control unit 104 may receive (step 1302) parameter data from the analyzer 102 and feed level data from the plurality of level measurement units 414, 614, 814. Based on the received data, the first control unit 104 may determine (step 1304) a change in the existing feed rate. The first control unit 104 may then transmit (step 1306) the change in feed rate to the feed control unit 120 and return to receive (1002) further indications.

Broadly speaking, it has been discussed hereinbefore that the analyzer 102 may receive a signal representative of a measurement related to operation of the electric arc furnace 140 and analyze the signal to determine a characteristic parameter. Based upon the characteristic parameter, the first control unit 104 may act to communicate to the second control unit 106 a change in the manner in which the electric arc furnace 140 is operating. Current set point offset and voltage set point offset have been discussed, as well as feed rate. It should be clear that other adjustable factors related to the manner in which the electric arc furnace 140 is operating may also be changed. Examples of adjustable factors include power set point offset, position of the electrode 142, an angle of tilt for the furnace vessel 144 and speed of rotation of one or more cooling fans. The electric arc furnace 140 may have an associated additive system for adding, to the furnace vessel 144, various substances that can change the nature of the contents (metal layer 402, 602, 802; slag layer 604, 804; foam layer 406, 806; feed 408, 608, 808) of the furnace vessel 144. The substances may, for example, include lime, carbon and coal.

In one example, carbon may be added to a scrap steel bucket used to store the feed 408 before the feed 408 is introduced to the furnace of FIG. 4. In another example, coal may be added to a rotary kiln feeding the smelting furnace of FIG. 6. In further examples, carbon may be added via sidewall lances together with natural gas and oxygen or via a hopper and feed pipe through apertures 412, 612, 812 on the furnace roof.

Although the analyzer 102 has been described, to this point, as receiving an electrical signal representative of a measurement related to the operation of the electric arc furnace 140, it is contemplated that the analyzer 102 may be configured to receive indications of non-electrical measurements related to the operation of the EAF 140. Such non-electrical measurements may be representative of vibrations and/or sounds in and/or around the EAF 140.

Aspects of the present application are directed toward mitigating an open arc condition. Indeed, the term "mitigating" in the present application is meant to reference both the act of taking steps to prevent the open arc condition as well as the act of taking steps, once in the open arc condition, to adjust the operation of the electric arc furnace to end the open arc condition and return to operation in the presence of the arc cavity 410, 610, 810.

The above-described implementations of the present application are intended to be examples only. Alterations, modifications and variations may be effected to the particular implementations by those skilled in the art without departing from the scope of the application, which is defined by the claims appended hereto.

What is claimed is:

1. A system for mitigating an open arc condition of an electric arc furnace having at least one electrode, the electric arc furnace having a predetermined optimized covered arc condition, comprising:

an analyzer adapted to:

receive a signal representative of an electrical signal measurement of the electrical power provided to an electric arc furnace; and analyze the signal to determine, by analyzing the electrical signal measurement, a characteristic electrical parameter representative of a current arc cover condition of the electric arc furnace;

a first control unit adapted to:

receive the characteristic electrical parameter;

determine, based upon the electrical characteristic parameter, a change in operation for the electric arc furnace when the characteristic electrical parameter is determined to be indicative of a deviation of the current arc cover condition from the predetermined optimized covered arc condition; and transmit, to a second control unit provided for the electric arc furnace, an indication of the change;

wherein the change in operation of the electric arc furnace includes a change in feed rate that is effective for correcting the deviation of the current arc cover condition from the predetermined optimized covered arc condition thereby mitigating an open arc condition.

2. The system of claim 1 wherein the electrical signal measurement comprises a voltage measurement.

3. The system of claim 2 wherein the electrical parameter comprises a voltage characteristic parameter.

4. The system of claim 3 wherein the voltage characteristic parameter comprises voltage harmonics.

5. The system of claim 3 wherein the voltage characteristic parameter comprises voltage fluctuation.

6. The system of claim 1 wherein the electrical signal measurement comprises an electrical current measurement.

7. The system of claim 6 wherein the electrical parameter comprises a parameter characteristic of current harmonics.

8. A method for optimizing arc cover of an electrode of an electric arc furnace, comprising:

receiving a characteristic electrical parameter representative of a current arc condition of the electric arc furnace at a first control unit;

determining, based upon the characteristic electrical parameter, an offset representative of a deviation of the current arc condition from a predetermined optimized covered arc condition;

determining, based upon the offset, a change in operation for the electric arc furnace for correcting the offset such that there is an absence of a deviation of the current arc cover condition from the predetermined optimized covered arc condition; and transmitting, to a second control unit provided for operation of the electric arc furnace, an indication of the change such that the change in operation of the electric arc furnace is effected;

wherein the change in operation for the electric arc furnace includes a change in feed rate that is effective for mitigating an open arc condition.

9. The method of claim 8 wherein the characteristic parameter comprises an indication of a harmonic of a current waveform of the electrical power provided to the electric arc furnace.

10. The method of claim 8 wherein the characteristic parameter comprises an indication of a harmonic of a voltage waveform of the electrical power provided to the electric arc furnace.

11. The method of claim 8 wherein the change in operation for the electric arc furnace further comprises a current set point offset.

12. The method of claim 8 wherein the characteristic parameter comprises an indication of fluctuations in the voltage of the electrical power provided to the electric arc furnace.

13. The method of claim 12 further comprising extracting an indication of a flicker in the voltage.

14. The method of claim 8 wherein the change in operation for the electric arc furnace further comprises an electrode position offset.

15. The method of claim 8 wherein the change in operation for the electric arc furnace further comprises a voltage set point offset.

16. The method of claim 8 wherein the change in operation for the electric arc furnace further comprises a power set point offset.

17. A method of open arc detection for an electric arc furnace, the method comprising:

obtaining an electrical signal measurement, based on current operating conditions of the electrical arc furnace, representative of a current arc cover condition of the electric arc furnace at a first control unit;

detecting, based upon the electrical signal measurement, that the current arc cover condition is indicative of an open arc condition;

determining, based upon the electrical signal measurement, a change to an operating condition of the electric arc furnace, where the change is effective to end the open arc condition; and transmitting, to a second control unit associated with operation of the electric arc furnace, an indication of the change such that the change to the operating condition is effected;

wherein:

the change to the operating condition includes coordinating, based upon the detecting of the open arc condition, feed control to the Electrical Arc Furnace for ending the open arc condition such that a predetermined optimized arc cover condition for the Electrical Arc Furnace is obtained, thereby ending the open arc condition.

18. The method of claim 17 wherein:

the Electrical Arc Furnace is a non-ferrous Electrical Arc Furnace.

19. The method of claim 17 wherein:

the Electrical Arc Furnace is a scrap steel Electrical Arc Furnace; and the change to the operating condition further includes coordinating, based upon the detecting of the open arc condition, a carbon and oxygen injection in the scrap steel Electrical Arc Furnace.

20. The method of claim 17 wherein:

the change to the operating condition further includes coordinating, based upon the detecting of the open arc condition, a slag and foam thickness in the Electrical Arc Furnace.

21. A method of open arc detection for an electric arc furnace, the method comprising:

obtaining an electrical signal measurement, based on current operating conditions of the electrical arc furnace, representative of a current arc cover condition of the electric arc furnace at a first control unit;

detecting, based upon the electrical signal measurement, that the current arc cover condition is indicative of an open arc condition;

determining, based upon the electrical signal measurement, a change to an operating condition of the electric arc furnace, where the change is effective to end the open arc condition;

transmitting, to a second control unit associated with operation of the electric arc furnace, an indication of the change such that the change to the operating condition is effected;

wherein:

the electric arc furnace is a scrap steel electric arc furnace; and the change to the operating condition includes coordinating, based upon the detecting of the open arc condition, a carbon and oxygen injection into the scrap steel electric arc furnace for ending the open arc condition such that a predetermined optimized arc cover condition for the scrap steel electrical arc furnace is obtained.

* * * * *